US009536647B2

(12) United States Patent
Hahn et al.

(10) Patent No.: US 9,536,647 B2
(45) Date of Patent: Jan. 3, 2017

(54) MULTI-LAYERED CHIP ELECTRONIC COMPONENT

(71) Applicant: SAMSUNG ELECTRO-MECHANICS CO., LTD., Suwon, Gyunggi-do (KR)

(72) Inventors: Jin Woo Hahn, Gyunggi-Do (KR); So Yeon Song, Gyunggi-Do (KR); Sung Yong An, Gyunggi-Do (KR); Byeong Cheol Moon, Gyunggi-Do (KR); Soo Hwan Son, Gyunggi-Do (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 125 days.

(21) Appl. No.: 13/715,899

(22) Filed: Dec. 14, 2012

(65) Prior Publication Data

US 2014/0062643 A1 Mar. 6, 2014

(30) Foreign Application Priority Data

Aug. 28, 2012 (KR) ..... 10-2012-0094540

(51) Int. Cl.
*H01F 5/00* (2006.01)
*H01F 27/28* (2006.01)
(Continued)

(52) U.S. Cl.
CPC ..... *H01F 5/003* (2013.01); *H01F 17/0013* (2013.01); *H01F 17/0033* (2013.01); *H01F 27/292* (2013.01)

(58) Field of Classification Search
CPC ..... H01F 5/00; H01F 27/28
(Continued)

(56) References Cited

U.S. PATENT DOCUMENTS 6,157,285 A 12/2000 Tokuda et al.
7,106,161 B2 * 9/2006 Tozawa et al. ..... 336/200
(Continued)

FOREIGN PATENT DOCUMENTS

CN 101889319 A 11/2010
JP 10055916 A * 2/1998
(Continued)

OTHER PUBLICATIONS

First Notification of Office Action issued in Chinese Patent Application No. 20130008006.9, mailed on Jul. 25, 2016; with English translation.
(Continued)

*Primary Examiner* — Tsz Chan
(74) *Attorney, Agent, or Firm* — McDermott Will & Emery LLP

(57) ABSTRACT

There is provided a multi-layered chip electronic component including: a multi-layered body formed by stacking a plurality of magnetic layers; and conductive patterns disposed between the plurality of magnetic layers and electrically connected in a lamination direction to form coil patterns, wherein in a case in which a single coil pattern in the coil pattern is projected in the length and width directions of the multi-layered body, when an area of the magnetic layer inside of the coil pattern is defined as Ai and an area of the magnetic layer outside of the coil pattern is defined as Ao, 0.40≤Ai:Ao≤1.03 is satisfied.

13 Claims, 7 Drawing Sheets

(51) Int. Cl.
*H01F 17/00* (2006.01)
*H01F 27/29* (2006.01)

(58) Field of Classification Search
USPC ..... 336/200, 232
See application file for complete search history.

(56) References Cited

U.S. PATENT DOCUMENTS

| | | | | |
|---|---|---|---|---|
| 8,102,234 | B2 | 1/2012 | Ozawa et al. | |
| 8,436,708 | B2 | 5/2013 | Tachibana et al. | |
| 2001/0017582 | A1 | 8/2001 | Sakata | |
| 2005/0134420 | A1* | 6/2005 | Nakao et al. | 336/234 |
| 2006/0006972 | A1 | 1/2006 | Tozawa et al. | |
| 2009/0051476 | A1* | 2/2009 | Tada et al. | 336/105 |
| 2010/0194513 | A1* | 8/2010 | Ozawa et al. | 336/200 |
| 2010/0283447 | A1* | 11/2010 | Tachibana et al. | 323/304 |

FOREIGN PATENT DOCUMENTS

| | | | | |
|---|---|---|---|---|
| JP | H10-335143 | A | | 12/1998 |
| JP | 2001-230119 | A | | 8/2001 |
| JP | 2003017327 | A | * | 1/2003 |
| JP | 2004-014549 | A | | 1/2004 |
| JP | 2005-142389 | A | | 6/2005 |
| JP | 2006-032430 | A | | 2/2006 |
| JP | 2008-130970 | A | | 6/2008 |
| JP | 2009-290121 | A | | 12/2009 |
| JP | 2010-192889 | A | | 9/2010 |
| KR | 2001-0085376 | A | | 9/2001 |
| WO | 2007/088914 | A1 | | 8/2007 |
| WO | 2009/081984 | A1 | | 7/2009 |

OTHER PUBLICATIONS

Notice of Office Action issued in corresponding Japanese Patent Application No. 2012-276525, mailed Oct. 25, 2016; with English translation.

* cited by examiner

MULTI-LAYERED CHIP ELECTRONIC COMPONENT

CROSS-REFERENCE TO RELATED APPLICATIONS

This application claims the priority of Korean Patent Application No. 10-2012-0094540 filed on Aug. 28, 2012, in the Korean Intellectual Property Office, the disclosure of which is incorporated herein by reference.

BACKGROUND OF THE INVENTION

Field of the Invention

The present invention relates to a multi-layered chip electronic component.

Description of the Related Art

An inductor, a multi-layered chip component, is a representative passive element capable of removing noise by configuring an electronic circuit together with a resistor and a capacitor.

A multi-layered chip type inductor may be manufactured by printing and stacking conductive patterns so as to form a coil in a magnetic substance or in a dielectric substance. The multi-layered chip inductor has a structure in which a plurality of magnetic or dielectric layers on which conductive patterns are formed are multi-layered. Internal conductive patterns within the multi-layered chip inductor are sequentially connected by via electrodes formed in each magnetic layer so as to form a coil structure within a chip to implement targeted inductance and impedance characteristics.

Recently, demand for miniaturization of the multi-layered chip inductor has increased. Even in the case of manufacturing the miniaturized multi-layered chip inductor, there is a defect in that a relatively large cutting margin to a chip size for preventing delamination is formed.

Therefore, a need exists for a development of a multi-layered chip inductor capable of securing high capacity while being miniaturized.

PRIOR ART DOCUMENT

Korean Patent Laid-Open Publication No. 2001-0085376
Japanese Patent Laid-Open Publication No. 2005-142389

SUMMARY OF THE INVENTION

An aspect of the present invention provides a multi-layered chip electronic component capable of securing high capacity while being miniaturized.

According to an aspect of the present invention, there is provided a multi-layered chip electronic component, including: a multi-layered body formed to be 2016-sized or smaller and including a plurality of magnetic layers on which conductive patterns are formed and via electrodes electrically connecting the conductive patterns to form coil patterns in a lamination direction, wherein in a case in which the coil pattern is projected in the length and width directions of the multi-layered body, when an area formed in the inside of the coil pattern is defined as Ai and an area formed outside of the coil pattern is defined as Ao, $0.40 \leq Ai:Ao \leq 1.03$ is satisfied, and when an area of the coil pattern is defined as Ae and the overall area of the multi-layered body in the length and width directions is defined as At, $0.13 \leq Ae:At \leq 0.78$ is satisfied.

The multi-layered body may include a first magnetic layer forming a common layer with the conductive pattern and a second magnetic layer interposed between the first magnetic layers.

The first magnetic layer may be printed to have a thickness equal to that of the conductive pattern that is printed on the second magnetic layer.

A length and a width of the multi-layered chip electronic component may have a range of 2.0±0.1 mm and 1.6±0.1 mm, respectively.

The Ai may be an area of the magnetic layer occupying an inside of the coil pattern.

The Ao may be an area of the magnetic layer occupying an outside of the coil pattern.

The coil pattern may include the conductive pattern in the width direction and the conductive pattern in the length direction, and a width of a margin part formed in the width direction with respect to the conductive pattern in the length direction may be narrower than a width of a margin part formed in the length direction with respect to the conductive pattern in the width direction.

According to another aspect of the present invention, there is provided a multi-layered chip electronic component, including: a multi-layered body formed by stacking a plurality of magnetic layers; and conductive patterns disposed between the plurality of magnetic layers and electrically connected in a lamination direction to form coil patterns, wherein in a case in which a single coil pattern in the coil pattern is projected in the length and width directions of the multi-layered body, when an area of the magnetic layer inside of the coil pattern is defined as Ai and an area of the magnetic layer outside of the coil pattern is defined as Ao, $0.40 \leq Ai:Ao \leq 1.03$ is satisfied.

When an area of the coil pattern is defined as Ae and an overall area of the multi-layered body projected in the length and width direction is defined as At, $0.13 \leq Ae:At \leq 0.78$ may be satisfied.

The magnetic layer may include: a second magnetic layer in which a magnetic green sheet is fired; and a first magnetic layer fired while having a magnetic substance applied thereto to have a thickness equal to that of the conductive pattern printed on the second magnetic layer.

The coil pattern may include the conductive pattern in the width direction and the conductive pattern in the length direction, and a width of a margin part formed in the width direction with respect to the conductive pattern in the length direction may be narrower than a width of a margin part formed in the length direction with respect to the conductive pattern in the width direction.

A length and a width of the multi-layered chip electronic component may have a range of 2.0±0.1 mm and 1.6±0.1 mm, respectively.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
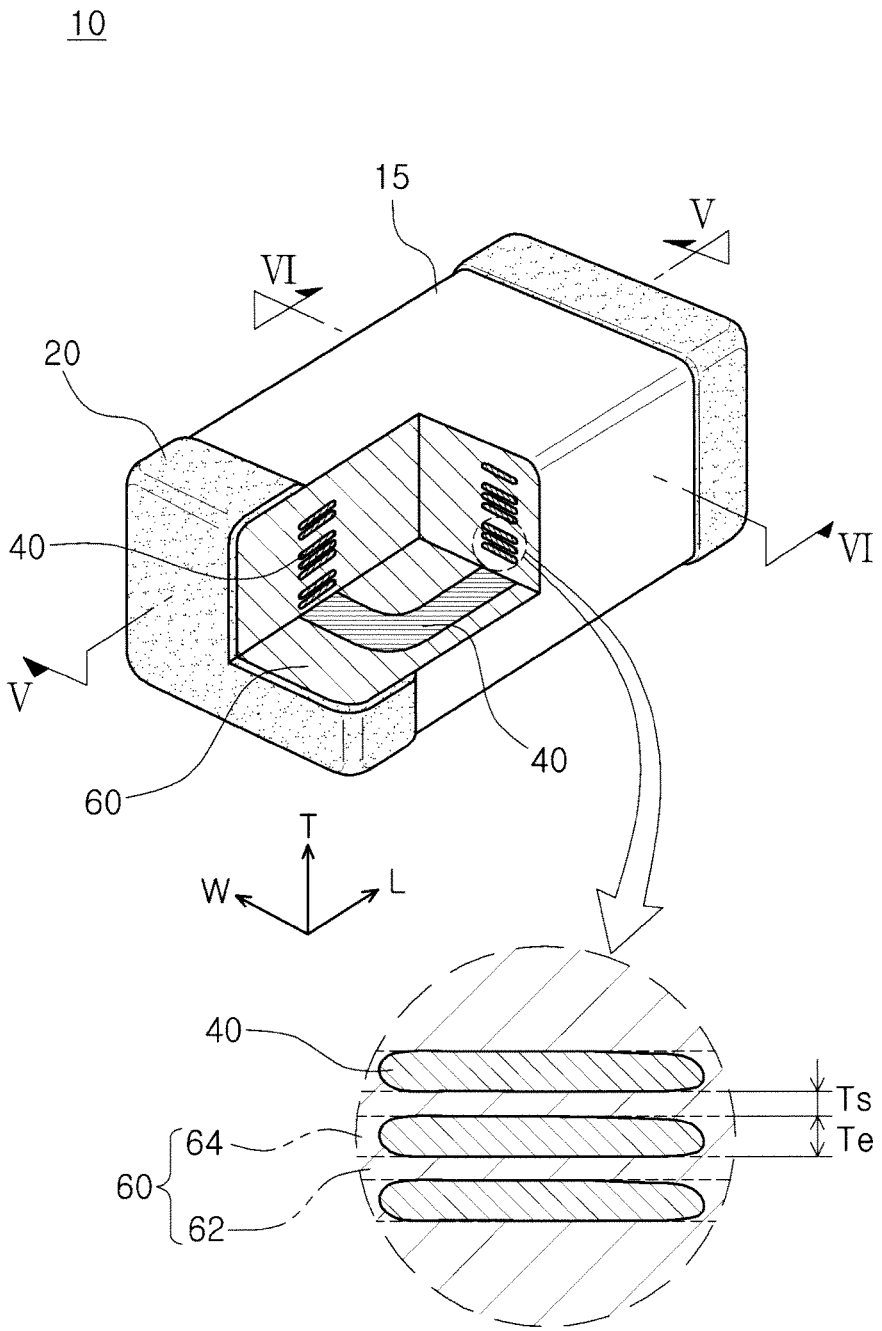
FIG. 1 is a partially cutaway perspective view of a multi-layered chip inductor according to an embodiment of the present invention.

Embodiments of the present invention will now be described in detail with reference to the accompanying drawings. However, it should be noted that the spirit of the present invention is not limited to the embodiments set forth herein and that those skilled in the art and understanding the present invention could easily accomplish retrogressive inventions or other embodiments included in the spirit of the present invention by the addition, modification, and removal of components within the same spirit, but those are to be construed as being included in the spirit of the present invention.

Further, like reference numerals will be used to designate like components having similar functions throughout the drawings within the scope of the present invention.

A multi-layered chip electronic component according to an embodiment of the present invention may be appropriately used as a chip inductor in which conductive patterns are formed on magnetic layers, chip beads, a chip filter, and the like.

Hereinafter, embodiments of the present invention will be described with reference to a multi-layered chip inductor.

Multi-Layered Chip Inductor

Figure 2A:
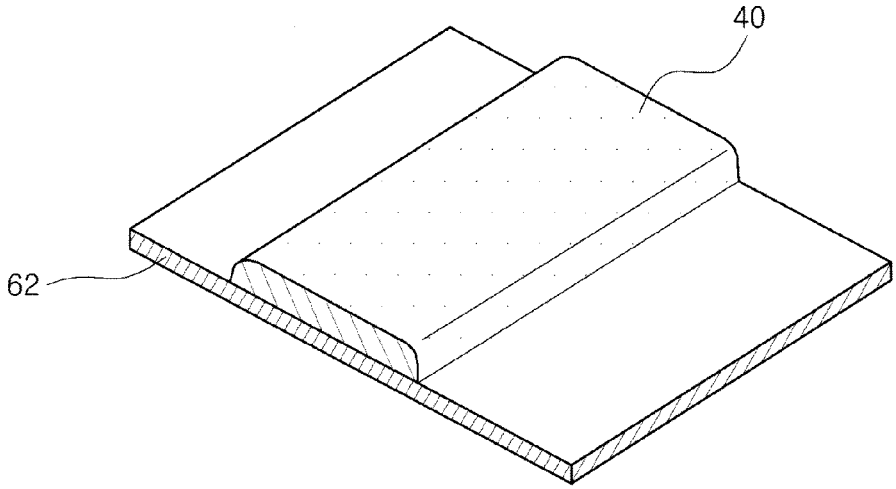
FIGS. 2A through 2C are diagrams schematically showing a case in which conductive patterns and magnetic layers of the multi-layered chip inductor of FIG. 1 are multi-layered.
Figure 2B:
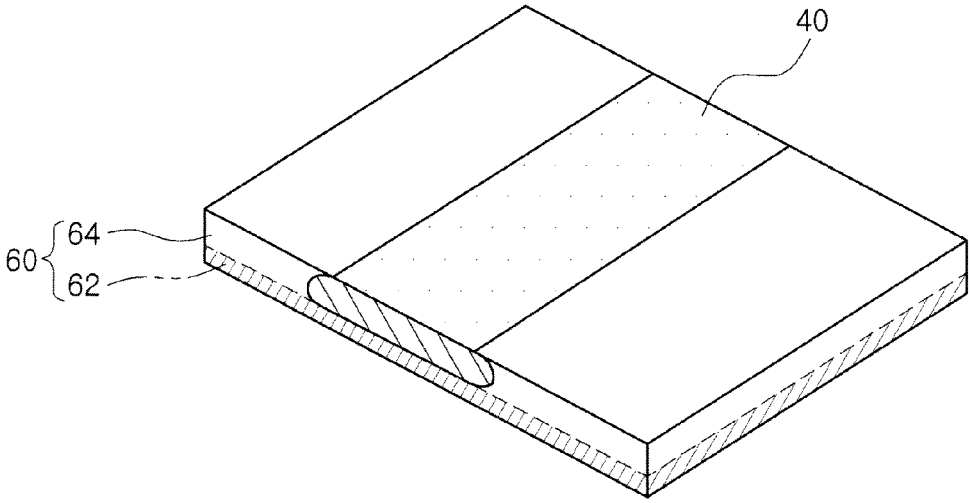
Figure 2C:
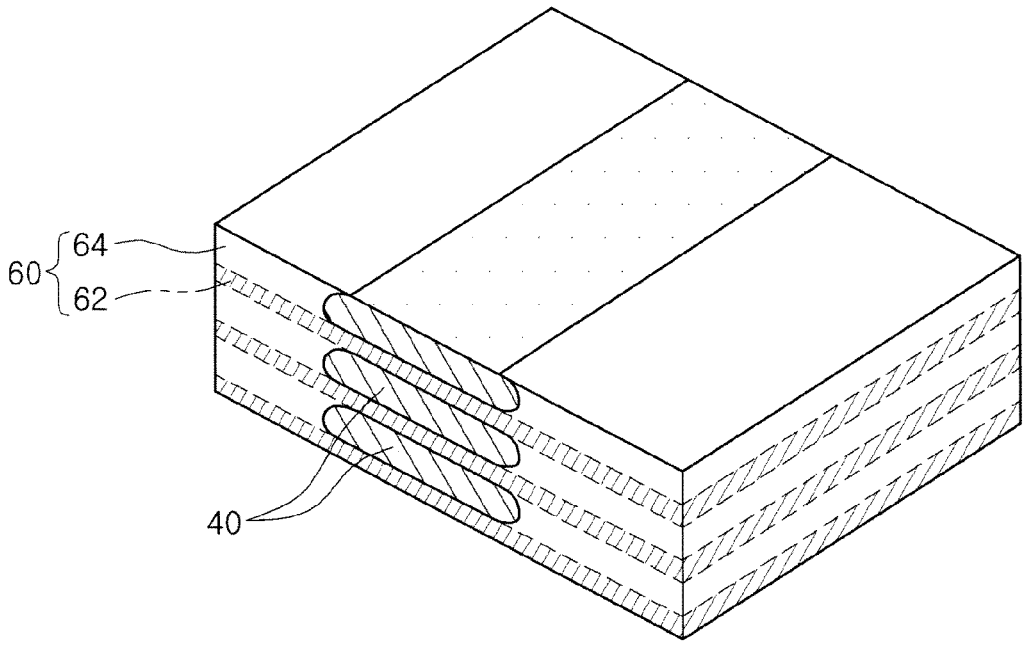
Figure 3:
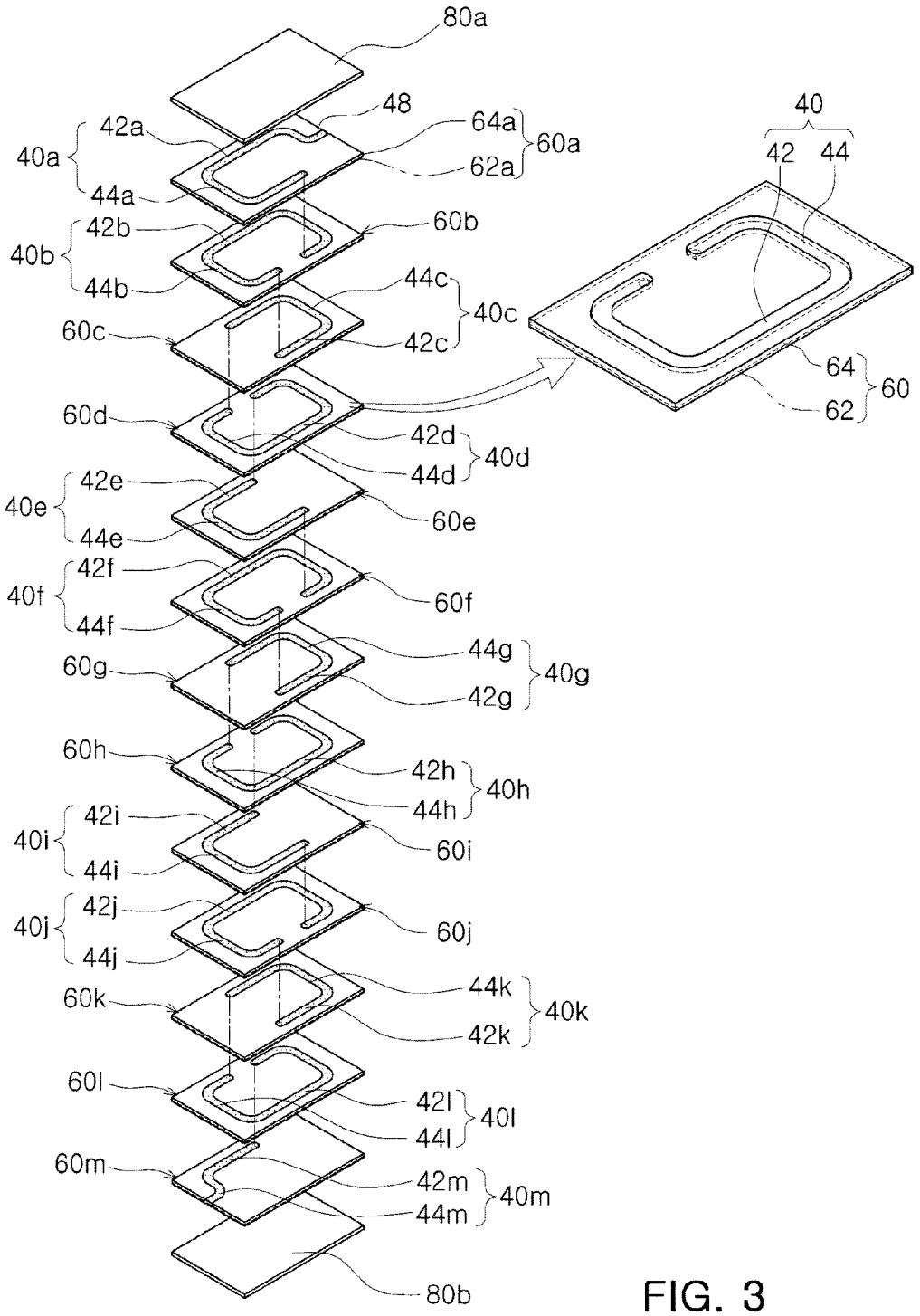
FIG. 3 is an exploded perspective view of the multi-layered chip inductor of FIG. 1.

FIG. 1 is a partially cutaway perspective view of a multi-layered chip inductor according to an embodiment of the present invention, FIGS. 2A through 2C are diagrams schematically showing a case in which conductive patterns and magnetic layers of the multi-layered chip inductor of FIG. 1 are multi-layered, and FIG. 3 is an exploded perspective view of the multi-layered chip inductor of FIG. 1.

Figure 4:
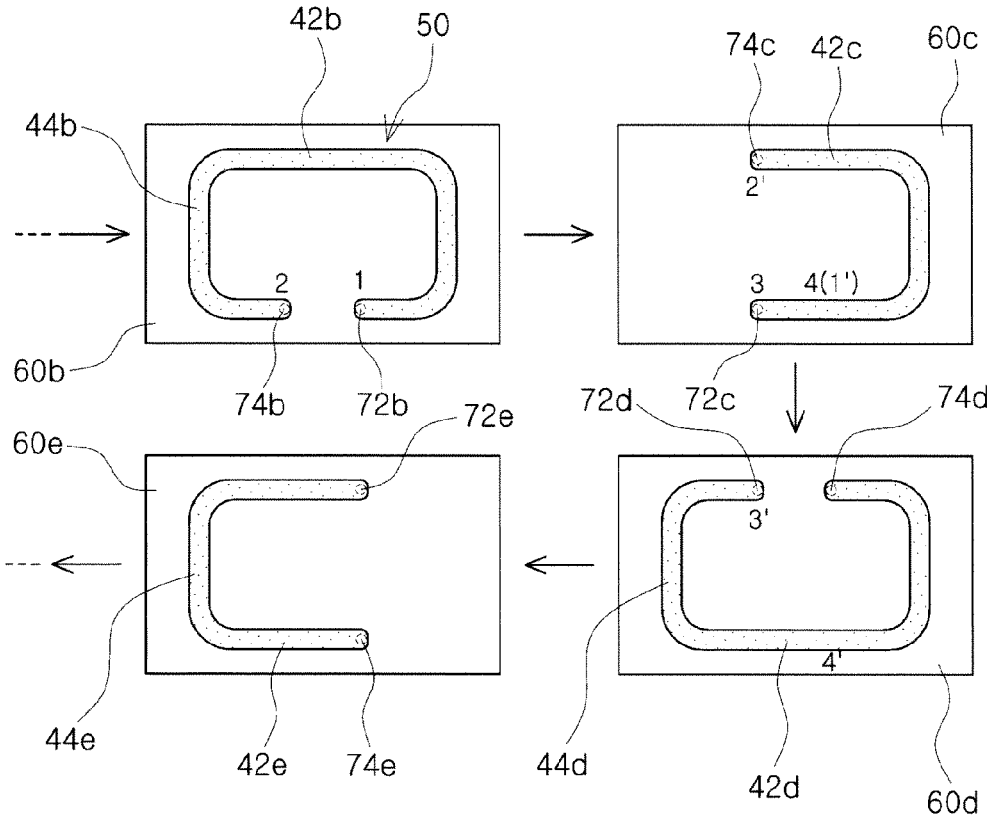
FIG. 4 is a schematic plan view showing an appearance of conductive patterns formed on the magnetic layers of FIG. 1.

In addition, FIG. 4 is a schematic plan view showing an appearance of conductive patterns formed on the magnetic layers of FIG. 1.

Referring to FIGS. 1 through 4, a multi-layered chip inductor 10 may include a multi-layered body 15, conductive patterns 40, magnetic layers 62 and 64, and external electrodes 20.

The multi-layered body 15 may be manufactured by printing the conductive patterns 40 on magnetic green sheets and stacking and sintering the magnetic green sheets on which the conductive patterns 40 are formed.

The multi-layered body 15 may have a hexahedral shape. When the magnetic green sheets are multi-layered and are sintered in a chip shape, the multi-layered body 15 may not be formed as a hexahedral shape having entirely straight lines, due to a sintering shrinkage of ceramic powder particles. However, the multi-layered body 15 may be formed to have a substantially hexahedral shape.

When defining hexahedral directions in order to clearly describe embodiments of the present invention, L, W, and T shown in FIG. 1 represent a length direction, a width direction, and a thickness direction, respectively. Here, the thickness direction may be used to have the same meaning as a direction in which magnetic layers are stacked.

An embodiment of FIG. 1 shows the chip inductor 10 having a rectangular parallelepiped shape in which a length direction is longer than a width or thickness direction.

Here, as shown in FIG. 2, in the present embodiment, the conductive patterns 40 may be printed on the magnetic green sheets and then, a magnetic substance may be applied thereto and printed thereon to have a thickness equal to that of the conductive pattern 40. That is, after being sintered, separate magnetic layers differentiated from the magnetic green sheets may be formed. After being sintered, the magnetic layer forming a common layer with the conductive pattern 40 may be defined as a first magnetic layer 64 and the sintered magnetic green sheet interposed between the first magnetic layers 64 within the multi-layered body 15 may be defined as a second magnetic layer 62.

The plurality of first and second magnetic layers 64 and 62 configuring the multi-layered body 15 are in a sintered state, and the adjacent first and second magnetic layers 64 and 62 may be integrated such that a boundary therebetween may not be able to be easily confirmed without using a scanning electron microscope (SEM).

Meanwhile, a size of the multi-layered chip inductor 10 according to the embodiment of the present invention may have a length and a width respectively having a range of 2.0±0.1 mm and 1.6±0.1 mm (2016-sized), including the external electrodes 20, and may be formed to be 2016-sized or smaller (that is, a length of the multi-layered body may be 2.1 mm or less and a width of the multi-layered body may be 1.7 mm or less).

The first and second magnetic layers 64 and 62 are formed of a Ni—Cu—Zn-based ferrite substance, a Ni—Cu—Zn—Mg-based ferrite substance, or a Mn—Zn-based ferrite substance, but the embodiment of the present invention is not limited to these substances.

Referring to FIGS. 2A to 2C, the conductive pattern 40 is printed on the ferrite green sheet 62 and dried (FIG. 2A) and a separate planarized magnetic layer 64 differentiated from the ferrite green sheet 62 is formed by printing a ferrite slurry as a paste in a space adjacent to the conductive pattern 40 so as to form a common layer with the conductive pattern 40. The ferrite green sheet 62 and the magnetic layer 64 planarized with the conductive pattern 40 form a single multi-layered carrier 60 (FIG. 2B). In addition, the multi-layered carrier 60 may be stacked in plural so that the conductive patterns 40 form coil patterns 50 (FIG. 4) in a lamination direction (FIG. 2C).

When forming the multi-layered chip inductor 10 as described above, no step is present between the conductive pattern 40 and the multi-layered carrier 60, which remarkably reduces a phenomenon in which the conductive pattern 40 is depressed to the magnetic layer 60 and is deformed even in the case of processes such as pressing or sintering being performed.

Figure 7:
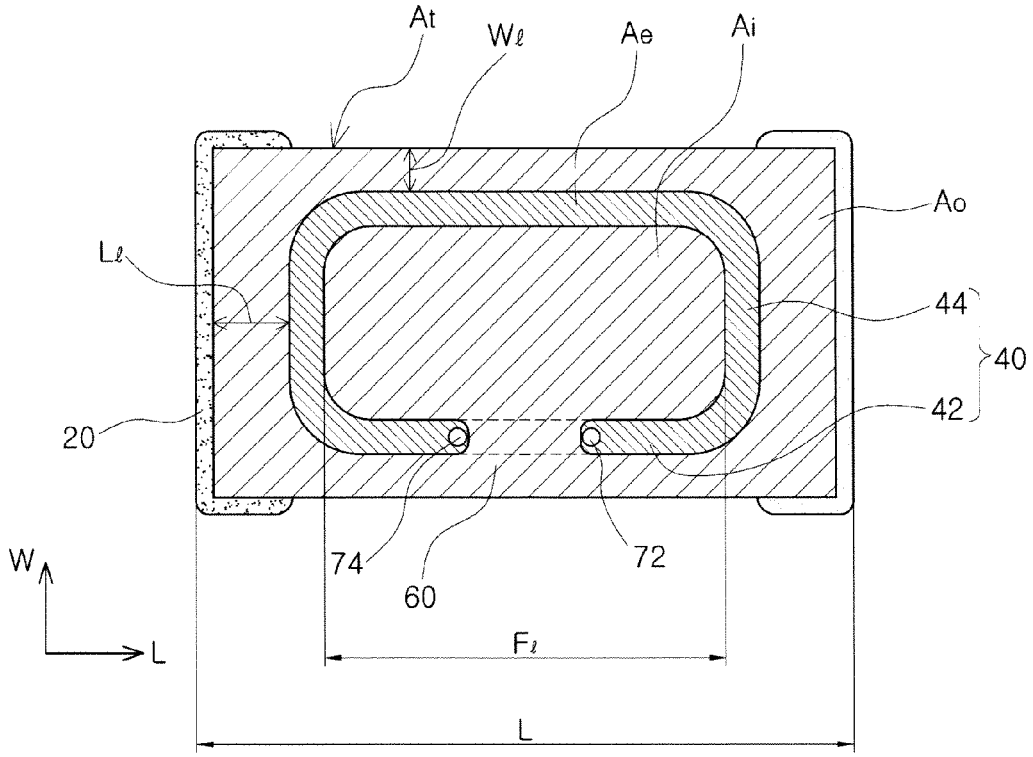
FIG. 7 is a schematic plan view showing a case in which conductive patterns are turned one time by polishing the multi-layered chip inductor of FIG. 1 in length and width directions.

As shown in FIG. 7, even when the magnetic layer 60 is exposed by polishing the multi-layered chip inductor in the length and width directions, the shape of the conductive patterns are not discontinued at the same thickness, but the shape of the conductive patterns 40 printed on the green sheet may be maintained as is.

The conductive patterns 40 may be formed by printing a conductive paste using silver (Ag) as a main component to have a predetermined thickness. The conductive patterns 40 may be electrically connected to the external electrodes 20 that are formed at both ends.

The external electrodes 20 are formed at both ends of the ceramic body 15 and may be formed by electroplating an alloy selected from Cu, Ni, Sn, Ag, and Pd. However, the embodiment of the present invention is not limited to these substances.

The conductive patterns 40 may include leads that are electrically connected to the external electrodes 20.

Referring to FIG. 3, a conductive pattern 40*a* on a single multi-layered carrier 60*a* includes a conductive pattern 42*a* in a length direction and a conductive pattern 44*a* in a width direction. The conductive pattern 40*a* is electrically connected to a conductive pattern 40*b* on another multi-layered carrier 60*b* having a magnetic layer 62*a* disposed therebetween through via electrodes 72 and 74 formed on the magnetic layer 62*a* to form the coil patterns 50 in a lamination direction.

All coil patterns 50, according to the embodiment of the present invention, have a turns amount of 9.5 times, but the embodiment of the present invention is not limited thereto. In order for the coil patterns 50 to have a turns amount of 9.5 times, thirteen multi-layered carriers 60*a*, 60*b*, . . . , 60*m* in which conductive patterns 40*a*, 40*b*, . . . , 40*m* are formed are disposed between top and bottom magnetic layers 80*a* and 80*b* forming a cover layer.

The embodiment of the present invention provides the conductive patterns 42*a* and 44*b* requiring two multi-layered carriers so as to form the coil patterns 50 having a turns amount of one time, but the present invention is not limited thereto and therefore, may require different numbers of multi-layered carriers according to a shape of the conductive pattern.

Describing a one-time turn amount of the coil patterns 50 with reference to FIG. 4, when a single via electrode 72*b* is defined as 1 and another via electrode 74*b* is defined as 2 in the conductive pattern 40*b* formed on the same magnetic layer 60*b*, a via electrode 72*c* of the conductive pattern 40*c* under the lamination direction corresponding to the 2 is defined as 3, and an opposite point of the conductive pattern 40*c* of the magnetic layer 60*c* facing the 1 is defined as 4, one-time turn (1→2→3→4) is formed counterclockwise from the 1, which may be defined as one turn. When 4 is defined as 1', the next one-time turn (1'→2'→3'→4') may be formed.

Figure 5:
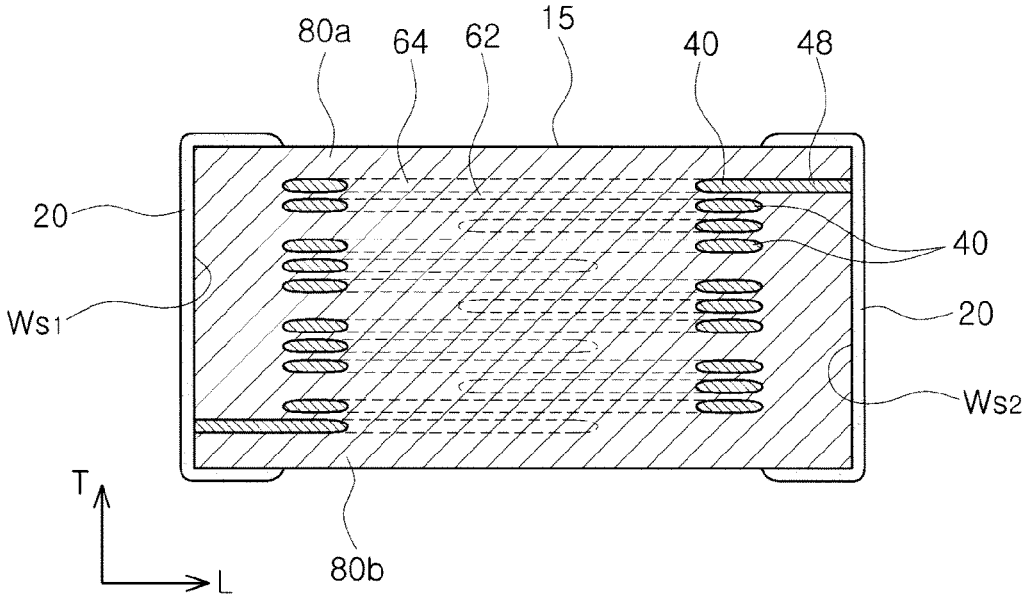
FIG. 5 is a schematic cross-sectional view taken along line V-V' of FIG. 1.
Figure 6:
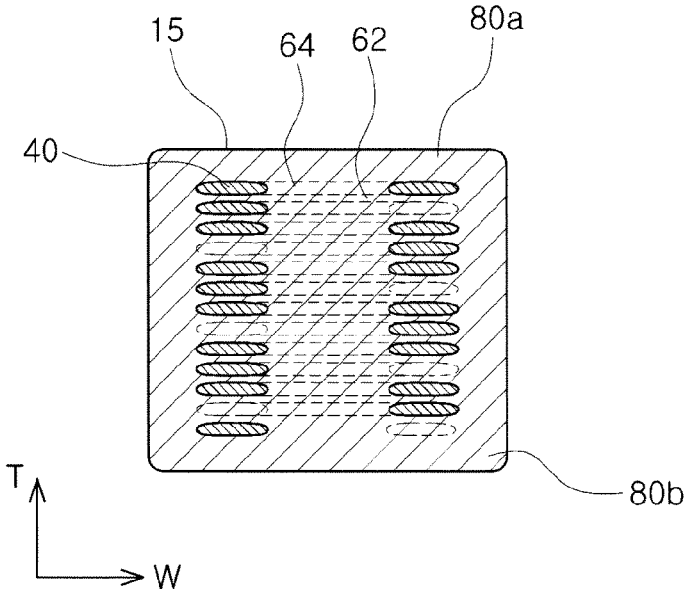
FIG. 6 is a schematic cross-sectional view taken along line VI-VI' of FIG. 1.

FIG. 5 is a schematic cross-sectional view taken along line V-V' of FIG. 1 and FIG. 6 is a schematic cross-sectional view taken along line VI-VI' of FIG. 1.

FIG. 5 shows that the multi-layered chip inductor of FIG. 1 is cut in a length direction L and a thickness direction T, while FIG. 6 shows that the multi-layered chip inductor of FIG. 1 is cut in a width direction W and a thickness direction T.

In the cross-sectional views of FIGS. 5 and 6, a portion in which the conductive patterns 40 are not formed is shown by a dotted line portion.

As shown in FIG. 5, when viewed in the length direction L and the thickness direction T, leads 48 that are electrically connected to the external electrodes 20 are formed on top and bottom magnetic layers in which the conductive patterns 40 are formed. The leads 48 are exposed to short sides Ws1 and Ws2 in a length direction of the ceramic body 15 and are electrically connected to the external electrodes 20.

The conductive patterns 40 form a common layer with the first magnetic layers 64 and may be disposed to face each other within the multi-layered body 15, having the second magnetic layer 62 therebetween.

Here, the first magnetic layers 64 may be printed to have a thickness equal to that of the conductive pattern 40.

FIG. 7 is a schematic plan view showing a case in which conductive patterns are turned one time by polishing the multi-layered chip inductor of FIG. 1 in length and width directions.

A detailed appearance in which a single coil pattern 50 is formed in the conductive pattern 40 can be appreciated from FIG. 7. In the coil pattern 50, a conductive pattern 44 in a width direction and a conductive pattern 42 in a length direction are electrically connected through via electrodes 72 and 74.

Here, a width W1 of a margin part formed in a width direction of the multi-layered body 15, with respect to the conductive pattern 42 in the length direction of the multi-layered body 15, may be formed to be narrower than a width L1 of a margin part formed in a length direction of the multi-layered body 15, with respect to the conductive pattern 44 in the width direction of the multi-layered body 15. This is to secure a length of the leads 48 extending to the external electrodes 20 in the uppermost and lowermost conductive patterns 40, as shown in FIG. 5.

The following Table 1 represents experimental results for each chip size regarding an effect of a ratio Ai:Ao of an area Ai formed at the inside of the coil pattern to an area Ao formed at the outside of the coil pattern on DC resistance Rdc of the multi-layered chip inductor and a delamination defect.

The chips of the following Table 1 are designed so that the area (for example, "Ao" of FIG. 7) formed at the outside of the coil pattern is smaller than the area (for example, "Ai" of FIG. 7) formed at the inside of the coil pattern in order to increase the inductance capacity. (That is, Ai:Ao>1)

TABLE 1

| Sample No. | size | Ai ($mm^2$) | Ao ($mm^2$) | Ai:Ao | Inductance With Respect To Target (%) | Rdc (mΩ) | Delamination Defect or not |
|---|---|---|---|---|---|---|---|
| 101 | 3216 | 2.38 | 2.19 | 1.09 | 108 | 102 | Good |
| 102 | 2520 | 2.32 | 2.15 | 1.08 | 106 | 98 | Good |
| 103 | 2016 | 1.52 | 1.36 | 1.12 | 89 | 150 | Bad |
| 104 | 2012 | 1.11 | 1.04 | 1.07 | 92 | 165 | Bad |
| 105 | 1608 | 0.61 | 0.56 | 1.09 | 89 | 173 | Bad |
| 106 | 1005 | 0.23 | 0.21 | 1.08 | 89 | 171 | Bad |
| 107 | 0603 | 0.082 | 0.075 | 1.09 | 87 | 170 | Bad |

As shown in Table 1, when the chip exceeds 2016 size, since the area Ao formed at the outside of the coil pattern is sufficiently large, the DC resistance Rdc is not large and the delamination defect does not occur, even in the case that the Ai:Ao value exceeds 1.03.

However, when the Ai:Ao value exceeds 1.03 in the 2016-sized or smaller chip, since the area Ao formed at the outside of the coil pattern is relatively small, the DC resistance Rdc may be increased and a delamination defect may occur, due to the small electrode area.

Therefore, in case of the 2016-sized or smaller chip, there is a need to adjust the Ai:Ao value as in the Inventive Example of the present invention in order to lower the DC resistance Rdc and prevent the delamination defect while securing the sufficient inductance.

In the Inventive Example of the present invention, when projecting the coil pattern 50 in the length and width directions of the multi-layered body 15, when the area formed in the inside of the coil pattern is defined as Ai and the area formed outside of the coil pattern is defined as Ao, Ai:Ao may satisfy a range of $0.40 \leq Ai:Ao \leq 1.03$.

Since the case in which the Ai:Ao value is less than 0.40 corresponds to the case in which the inner area of the coil pattern 50 is small, it is difficult to implement the inductance capacity, and since the case in which the Ai:Ao exceeds 1.03 corresponds to the case in which the coil pattern 50 is relatively long, the DC resistance Rdc is increased and thus, the delamination defect may occur due to the electrode exposure.

In addition, according to another Inventive Example of the present invention, when the area of the coil pattern is defined as Ae and the overall area of the multi-layered body in the length and width directions is defined as At, Ae:At may satisfy $0.13 \leq Ae:At \leq 0.78$.

When the Ae:At is less than 0.13, the cross sectional area of the conductive pattern 40 is reduced and therefore, the DC resistance Rdc is increased and the coil pattern 50 formed by the conductive pattern 40 may be disconnected to generate an opening. In addition, when the Ae:At exceeds 0.78, the delamination defect may occur.

Experimental Example

The multi-layered chip inductor according to the Inventive Examples of the present invention and Comparative Examples was manufactured as follows. A plurality of magnetic green sheets manufactured by applying a slurry including the Ni—Zn—Cu-based ferrite powder on a carrier film and drying the slurry were prepared.

Next, the conductive patterns were formed by applying a silver (Ag) conductive paste to the magnetic green sheet using a screen. In addition, the single multi-layered carrier was formed together with the magnetic green sheet by applying the ferrite slurry to the magnetic green sheet around the conductive pattern so as to be a common layer with the conductive pattern.

The multi-layered carriers in which the conductive patterns are formed were repeatedly multi-layered and the conductive patterns were electrically connected, thereby forming the coil pattern in the lamination direction. Here, the via electrodes are formed on the magnetic green sheet to electrically connect upper conductive patterns with lower conductive patterns, having the magnetic green sheet therebetween.

Here, the multi-layered carriers were multi-layered within a range of 10 layers to 20 layers, which were isostatically pressed under pressure conditions of 1000 kgf:cm$^2$ at 85° C. The pressed chip laminate was cut in the form of an individual chip and the cut chip was subjected to a debinder process by being maintained for 40 hours at 230° C. under an air atmosphere.

Next, the chip laminate was fired under the air atmosphere at a temperature of 950° C. or less. In this case, the size of the fired chip was 2.0 mm×1.6 mm (L×W), to be 2016-sized.

Next, the external electrodes were formed by processes such as the applying of external electrodes, electrode firing, plating, and the like.

Here, samples of the multi-layered chip inductor were manufactured so that the area Ai formed in the inside of the coil pattern, the area Ao formed at the outside of the coil pattern, the area Ae of the coil pattern, and the overall area At of the multi-layered body in the length and width directions are variously changed, when projecting the single coil pattern in the length and width directions of the multi-layered body.

Ai, Ao, Ae, and At were measured by performing a high magnification image photographing on the cut cross section obtained by being polished in the length and width directions of the multi-layered body 15 using an optical microscope and analyzing the photographed high magnification image using a computer program such as a SigmaScan Pro, or the like.

Hereinafter, the embodiments of the present invention will be described in more detail with reference to the experimental data of the Inventive Examples of the present invention and the Comparative Examples.

The following Table 2 shows results obtained by measuring the inductance, the DC resistance and the occurrence frequency of delamination according to the Ai:Ao value in the cross section cut in the length and width directions and Table 3 shows results obtained by measuring the inductance, the DC resistance, and the occurrence frequency of delamination according to the Ai:Ae value and the Ae:At value.

The inductance was measured by using the LCR meter of the Agilent 4286A, while the DC resistance Rdc was measured by using the milliohm meter of the Agilent 4338B.

TABLE 2

| Sample No. | size | Ai (mm$^2$) | Ao (mm$^2$) | Ai:Ao | Inductance With Respect To Target (%) | Rdc (mΩ) | Occurrence of Delamination (Number/100) |
|---|---|---|---|---|---|---|---|
| 1* | 2016 | 0.73 | 2.05 | 0.36 | 77 | 81 | 0 |
| 2 | | 0.80 | 1.99 | 0.40 | 81 | 87 | 0 |
| 3 | | 0.90 | 1.90 | 0.47 | 84 | 99 | 0 |
| 4 | | 1.02 | 1.79 | 0.57 | 87 | 109 | 0 |
| 5 | | 1.14 | 1.69 | 0.67 | 90 | 118 | 0 |
| 6 | | 1.25 | 1.59 | 0.79 | 93 | 129 | 0 |
| 7 | | 1.37 | 1.48 | 0.92 | 96 | 132 | 0 |
| 8 | | 1.45 | 1.41 | 1.03 | 99 | 146 | 0 |
| 9* | | 1.52 | 1.36 | 1.12 | 89 | 150 | 5 |
| 10* | | 1.57 | 1.31 | 1.21 | 85 | 153 | 15 |

*Comparative Examples

Referring to Table 2, in the case of sample 1 in which the Ai:Ao value was less than 0.40, the inductance capacity was low and in the case of samples 9 and 10 in which the Ai:Ao value exceeds 1.03, the DC resistance Rdc was increased. In particular, in the case of samples 9 and 10, the delamination defect occurred due to the electrode exposure. In the case of samples 2 to 8, Inventive Examples of the present invention, sufficient inductance capacity could be secured and delamination did not occur.

TABLE 3

| Sample No. | size | Ai:Ae | Ae:At | Fl:L | Inductance With Respect To Target (%) | Rdc (mΩ) | Allowable Current (mA) | Occurrence of Delamination (Number/100) |
|---|---|---|---|---|---|---|---|---|
| 11* | 2016 | 4.80 | 0.09 | 0.78 | 106 | 154 | 260 | 0 |
| 12 | | 3.48 | 0.13 | 0.76 | 105 | 135 | 256 | 0 |
| 13 | | 1.79 | 0.22 | 0.70 | 101 | 101 | 241 | 0 |
| 14 | | 1.00 | 0.33 | 0.64 | 95 | 71 | 227 | 0 |
| 15 | | 0.57 | 0.46 | 0.55 | 92 | 54 | 217 | 0 |
| 16 | | 0.42 | 0.54 | 0.50 | 88 | 49 | 211 | 0 |
| 17 | | 0.24 | 0.67 | 0.43 | 83 | 41 | 198 | 0 |
| 18 | | 0.14 | 0.78 | 0.36 | 81 | 34 | 191 | 0 |
| 19* | | 0.10 | 0.83 | 0.33 | 77 | 31 | 189 | 25 |

*Comparative Example

Referring to Table 3, it can be appreciated that the Ae:At is increased, the area Ai:Ae of the coil pattern to the area formed in the inside of the coil pattern and the length F1:L in the length direction of the multi-layered chip inductor including the external electrode to the inner length of the coil pattern in the length direction are reduced.

In addition, in the case of sample 11 in which the Ae:At value was less than 0.13, the DC resistance Rdc was increased and the opening occurred in the circuit. In addition, in the case of sample 19 in which the Ae:At value exceeded 0.78, the area occupied by the electrode was overly increased and the inner and outer areas of the coil were considerably reduced, which leads to the degradation in capacity and the delamination defect.

As set forth above, according to the multi-layered chip electronic component according to the embodiment of the present invention, delamination defects may be remarkably reduced while increasing the capacity even when being miniaturized.

While the present invention has been shown and described in connection with the embodiments, it will be apparent to those skilled in the art that modifications and variations can be made without departing from the spirit and scope of the invention as defined by the appended claims.

What is claimed is:

1. A multi-layered chip electronic component, comprising:

a multi-layered body including a plurality of magnetic layers on which conductive patterns are formed and via electrodes electrically connecting the conductive patterns to form coil patterns in a lamination direction, the plurality of magnetic layers including first magnetic layers forming a common layer with the conductive patterns and second magnetic layers interposed between the first magnetic layers, wherein:

the coil pattern is projected in the length and width directions of the multi-layered body, an area formed in the inside of the coil pattern is defined as Ai and an area formed outside of the coil pattern is defined as Ao, $0.57 \leq Ai:Ao \leq 1.03$ being satisfied, and an area of the coil pattern is defined as Ae and the overall area of the multi-layered body in the length and width directions is defined as At, $0.13 \leq Ae:At \leq 0.78$ being satisfied.

2. The multi-layered chip electronic component of claim 1, wherein the first magnetic layer is printed to have a thickness equal to that of the conductive pattern that is printed on the second magnetic layer.

3. The multi-layered chip electronic component of claim 1, wherein a length and a width of the multi-layered chip electronic component have a range of 2.0±0.1 mm and 1.6±0.1 mm, respectively.

4. The multi-layered chip electronic component of claim 1, wherein the Ai is an area of the magnetic layer occupying an inside of the coil pattern.

5. The multi-layered chip electronic component of claim 1, wherein the Ao is an area of the magnetic layer occupying an outside of the coil pattern.

6. The multi-layered chip electronic component of claim 1, wherein the coil pattern includes the conductive pattern in the width direction and the conductive pattern in the length direction, and a width of a margin part formed in the width direction with respect to the conductive pattern in the length direction is narrower than a width of a margin part formed in the length direction with respect to the conductive pattern in the width direction.

7. A multi-layered chip electronic component, comprising:

a multi-layered body formed by stacking a plurality of magnetic layers; and conductive patterns disposed between the plurality of magnetic layers and electrically connected in a lamination direction to form coil patterns, the plurality of magnetic layers including first magnetic layers forming a common layer with the conductive patterns and second magnetic layers interposed between the first magnetic layers, wherein:

a single coil pattern in the coil pattern is projected in the length and width directions of the multi-layered body, and an area of the magnetic layer inside of the coil pattern is defined as Ai, and an area of the magnetic layer outside of the coil pattern is defined as Ao, $0.57 \leq Ai:Ao \leq 1.03$ being satisfied.

8. The multi-layered chip electronic component of claim 7, wherein an area of the coil pattern is defined as Ae and an overall area of the multi-layered body projected in the length and width direction is defined as At, $0.13 \leq Ae:At \leq 0.78$ being satisfied.

9. The multi-layered chip electronic component of claim 7, wherein the magnetic layer includes:

a second magnetic layer including a fired magnetic green sheet; and a first magnetic layer fired while having a magnetic substance applied thereto to have a thickness equal to that of the conductive pattern printed on the second magnetic layer.

10. The multi-layered chip electronic component of claim 7, wherein the coil pattern includes the conductive pattern in the width direction and the conductive pattern in the length direction, and a width of a margin part formed in the width direction with respect to the conductive pattern in the length direction is narrower than a width of a margin part formed in the length direction with respect to the conductive pattern in the width direction.

11. The multi-layered chip electronic component of claim 7, wherein a length and a width of the multi-layered chip electronic component have a range of 2.0±0.1 mm and 1.6±0.1 mm, respectively.

12. The multi-layered chip electronic component of claim 7, wherein a length of the multi-layered body is 2.1 mm or less and a width of the multi-layered body is 1.7 mm or less.

13. The multi-layered chip electronic component of claim 7, wherein:

the first magnetic layer is printed to have a thickness equal to that of the conductive pattern that is printed on the second magnetic layer, and the first magnetic layer is printed to have a thickness greater than that of the second magnetic layer.

* * * * *